US008353719B2

(12) United States Patent
Watts

(10) Patent No.: US 8,353,719 B2
(45) Date of Patent: Jan. 15, 2013

(54) JOINED CORD CONNECTION PROTECTOR WITH TOP AND BOTTOM CONFORMING TO TOP AND BOTTOM OF TWO JOINED CORD CONNECTORS

(76) Inventor: Dustin Watts, Ozark, AR (US)

( * ) Notice: Subject to any disclaimer, the term of this patent is extended or adjusted under 35 U.S.C. 154(b) by 0 days.

(21) Appl. No.: 12/904,099

(22) Filed: Oct. 14, 2010

(65) Prior Publication Data

US 2012/0122337 A1 May 17, 2012

Related U.S. Application Data

(60) Provisional application No. 61/278,625, filed on Oct. 13, 2009.

(51) Int. Cl.
*H01R 13/60* (2006.01)

(52) U.S. Cl. ..... 439/528

(58) Field of Classification Search ..... 439/527–528, 439/367–373, 271, 587; 174/134, 48–49
See application file for complete search history.

(56) References Cited

U.S. PATENT DOCUMENTS

| | | | | |
|---|---|---|---|---|
| 5,243,135 | A * | 9/1993 | Shotey | 174/67 |
| 6,699,060 | B1 * | 3/2004 | Scott | 439/373 |
| 7,347,712 | B2 * | 3/2008 | O'Connell et al. | 439/373 |
| 2005/0095907 | A1 * | 5/2005 | Ng et al. | 439/528 |
| 2010/0227498 | A1 * | 9/2010 | Byrne | 439/528 |
| 2011/0230085 | A1 * | 9/2011 | Castagnola et al. | 439/528 |

* cited by examiner

*Primary Examiner* — Chandrika Prasad
(74) *Attorney, Agent, or Firm* — Russ Weinzimmer; Russ Weinzimmer & Associates PC

(57) ABSTRACT

A solid molded cord connection protector for robust protection of joined cord connectors is disclosed, which protects cord connections and cord connectors from being crushed by large external forces and/or high pressure. The cord connection protector includes a bottom and top robust solid mold, each mold custom-designed to conform to a substantially bottom or top side of joined portions of two cords joined together by cord connectors. A hinge connects the top and bottom molds via their respective back sides; and a fastener fastens the top and bottom molds together at their front sides. The cord connection protector completely encloses the solid molds firmly around the entire surface of the joined portions of the two cords, thereby providing robust protection of the joined cord connectors and robust protection of the cord connection. In some embodiments, the cord connection protector is capable of preventing separation and/or crushing of the cord connectors.

10 Claims, 6 Drawing Sheets

JOINED CORD CONNECTION PROTECTOR WITH TOP AND BOTTOM CONFORMING TO TOP AND BOTTOM OF TWO JOINED CORD CONNECTORS

CROSS-REFERENCE TO RELATED APPLICATIONS

This application claims priority to U.S. Provisional Patent Application 61/278,625 having a filing date of Oct. 13, 2009, and entitled "The Cord Cuff", which is incorporated herein by reference in its entirety.

FIELD

The invention relates generally to electrical cords, and more particularly to electrical cord accessories.

BACKGROUND

Electrical power cords are a common piece of equipment, used for providing electrical power for a wide variety of professional and domestic applications. It is often required that electrical cords be connected in a daisy-chain, to extend electrical power from one cord to another so as to extend further than a single cord. One cord is joined to another by connecting respective cord connectors.

Many issues can arise when using cord connectors, such as accidental separation of the connectors when tension is applied to the cords, or moisture causing an electrical short, thereby compromising their function. Furthermore, external pressure bearing down on the cord connectors, such as being run over by a heavy vehicle (e.g., a truck) can crush the cord connector, rendering them non-functional, and possibly dangerous.

Protectors of cord connections have been proposed and are known. These cord connection protectors encase portions of joined cords and the cord connectors joining the cords, so as to protect the cord connections and the cord connectors themselves, from being disconnected and/or from being adversely affected by weather conditions, such as moisture or ice. However, these cord connection protectors do not sufficiently protect cord connections and cord connectors from all possible external forces and disturbances. Strong forces and external pressure can damage and/or deform existing cord connection protectors and therefore, potentially the cord connections and cord connectors themselves.

SUMMARY

A solid molded cord connection protector for robust protection of joined cord connectors is claimed, which protects cord connections and cord connectors from being crushed by large external forces and/or high pressure, through the use of robust solid molded material that fits closely around the cords and cord connectors.

In one embodiment, a solid molded cord connection protector for robust protection of joined cord connectors comprises: a bottom robust solid mold that is custom-designed to conform to a substantially bottom side of joined portions of two cords, the two cords being joined together by cord connectors; a top robust solid mold that is custom-designed to conform to a substantially top side of the joined portions of the two cords; a hinge connecting a back side of the top robust solid mold with a back side of the bottom robust solid mold, so as to enable pivoting of the top robust solid mold relative to the bottom robust solid mold about the hinge; and a fastener capable of fastening a front side of the top robust solid mold to a front side of the bottom robust solid mold when the cord connection protector is in a closed position, so as to completely enclose the solid mold of the cord connection protector firmly around the entire surface of the joined portions of the two cords, thereby providing robust protection of the joined cord connectors and robust protection of the cord connection.

In some embodiments, the cord connection protector is capable of preventing separation of the cord connectors. In some embodiments, the cord connection protector is capable of preventing moisture from contacting the cord connectors. In some embodiments, the cord connection protector is capable of preventing performance-disturbing pressure from being placed upon the cord connectors. In some embodiments, the cord connection protector is capable of preventing crushing of the cord connectors.

In some embodiments, the cord connection protector is made from material of sufficient robustness so as to enable repeated use. In some of these embodiments, the material is rubber. In some embodiments, the cord connection protector further comprises at least one channel for accommodating at least one of the cord portions. In some of embodiments, the cord connection protector further comprises a watertight seal. In some of these embodiments, the watertight seal is a rubber lining.

BRIEF DESCRIPTION OF THE DRAWINGS

The invention will be more fully understood by reference to the detailed description, in conjunction with the following figures, wherein.

DETAILED DESCRIPTION

Figure 1:
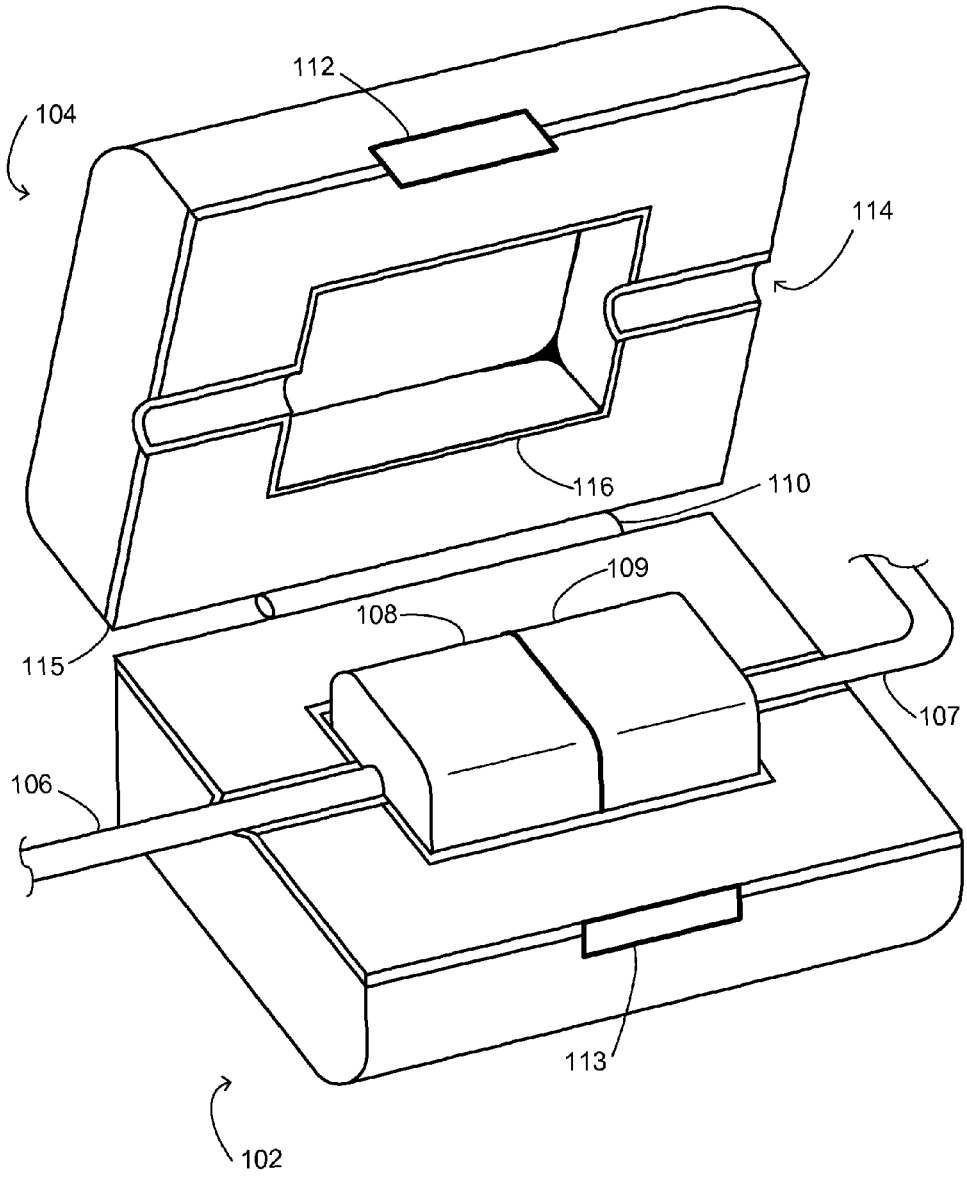
FIG. 1 is an oblique front view of an embodiment of the cord connection protector that is configured to envelop cords with substantially rectangular cord connectors.

FIG. 1 is an oblique front view of an embodiment of the cord connection protector that is configured to envelop cords with substantially rectangular cord connectors. A cord connection protector 100 is provided, having a bottom solid mold 102 and a top solid mold portion 104, and capable of housing a portion of two cords 106, 107 and their connectors 108, 109. A hinge 110 connects a back side of the top mold with a back side of the bottom mold, so as to enable pivoting of the top and bottom molds about the hinge 110. A latch fastener 112 is capable of locking the cord connection protector 100 closed so as to enclose the protector 100 firmly around the entire surface of the joined portions of the two cords 108, 109. A channel 114 closes firmly around the cords 106, 107. In the embodiment shown, a watertight seal 115 is shown, which in preferred embodiments can be a rubber seal. A customized compartment 116 provides close-fitting enclosure around the cord connectors.

Figure 2:
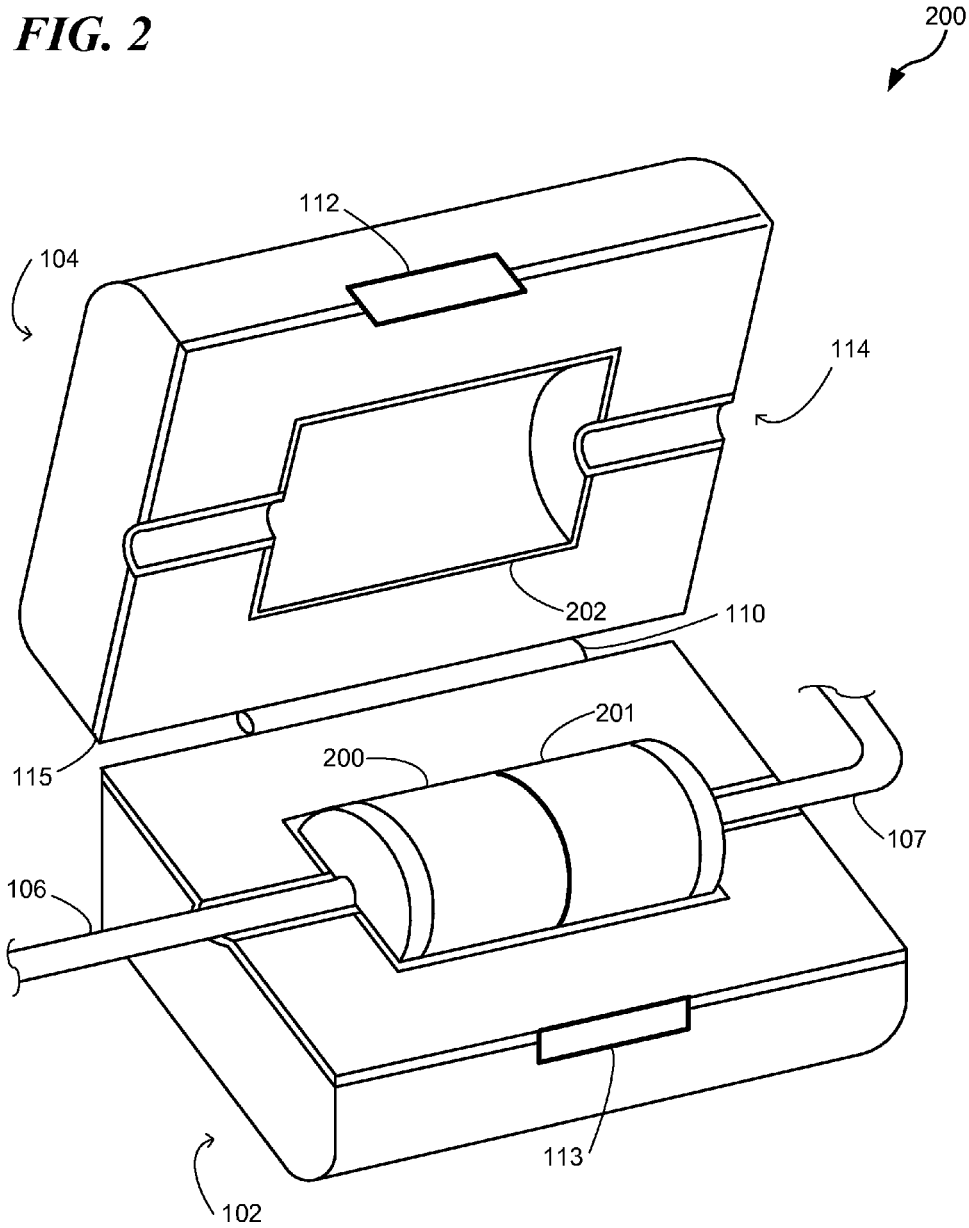
FIG. 2 is an oblique front view of an alternative embodiment of the cord connection protector that is configured to envelop cords with substantially circumferential cord connectors.

FIG. 2 is an oblique front view of an alternative embodiment of the cord connection protector that is configured to envelop cords with substantially circumferential cord connectors 200, 202, and a customized compartment 204 accommodates these connectors 200, 202.

Figure 3:
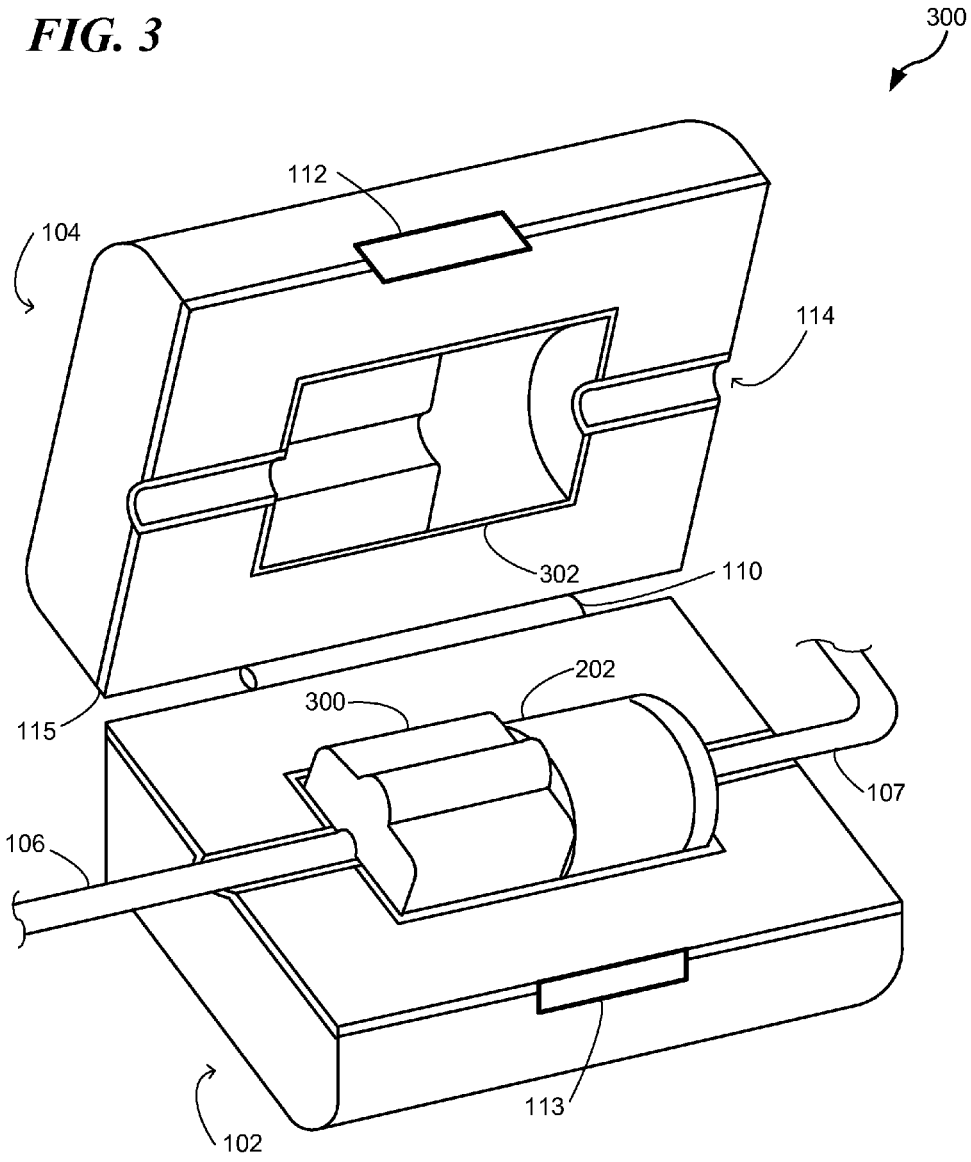
FIG. 3 is an oblique front view of an alternative embodiment of the cord connection protector that is configured to accommodate two differently shaped cord connectors.

FIG. 3 is an oblique front view of an alternative embodiment of the cord connection protector that is configured to accommodate two differently shaped cord connectors 300, 202, and a customized compartment accommodates these connectors 300, 202.

Figure 4:
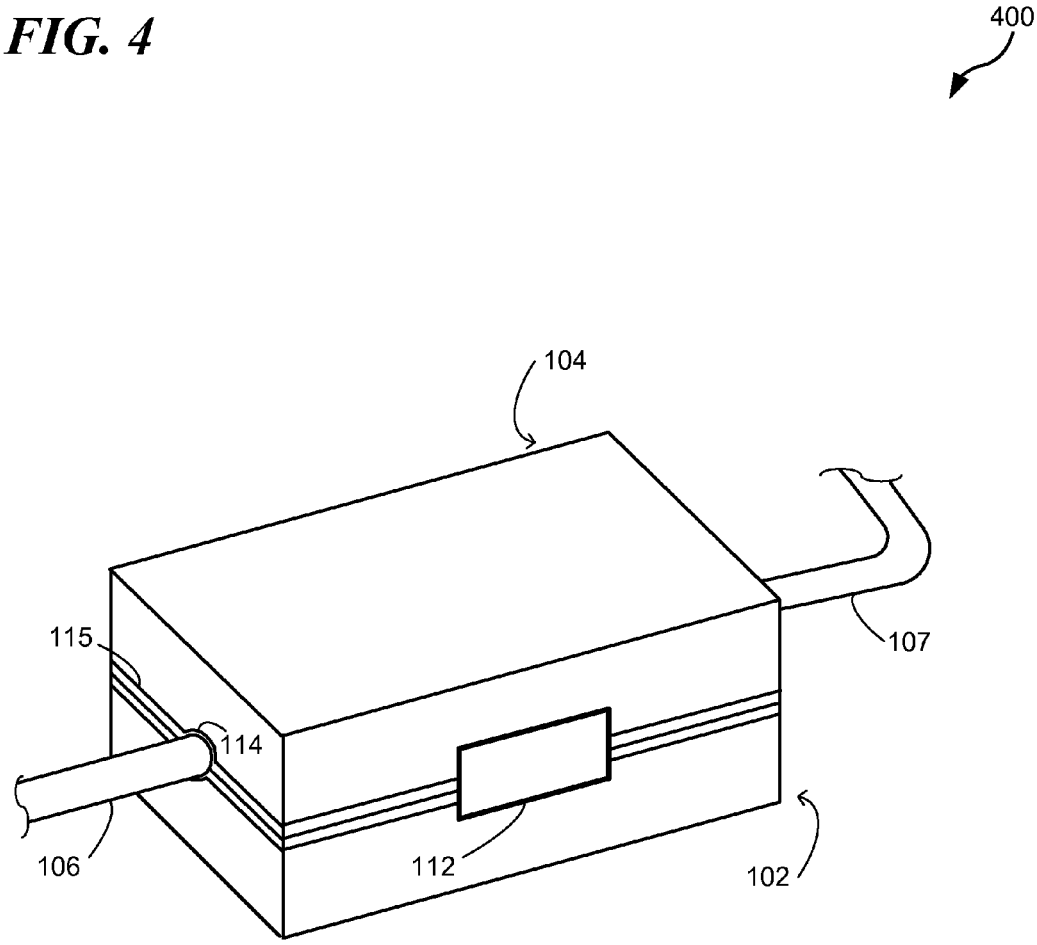
FIG. 4 is an oblique front view of the embodiment shown in FIG. 1 in the closed position.
Figure 5:
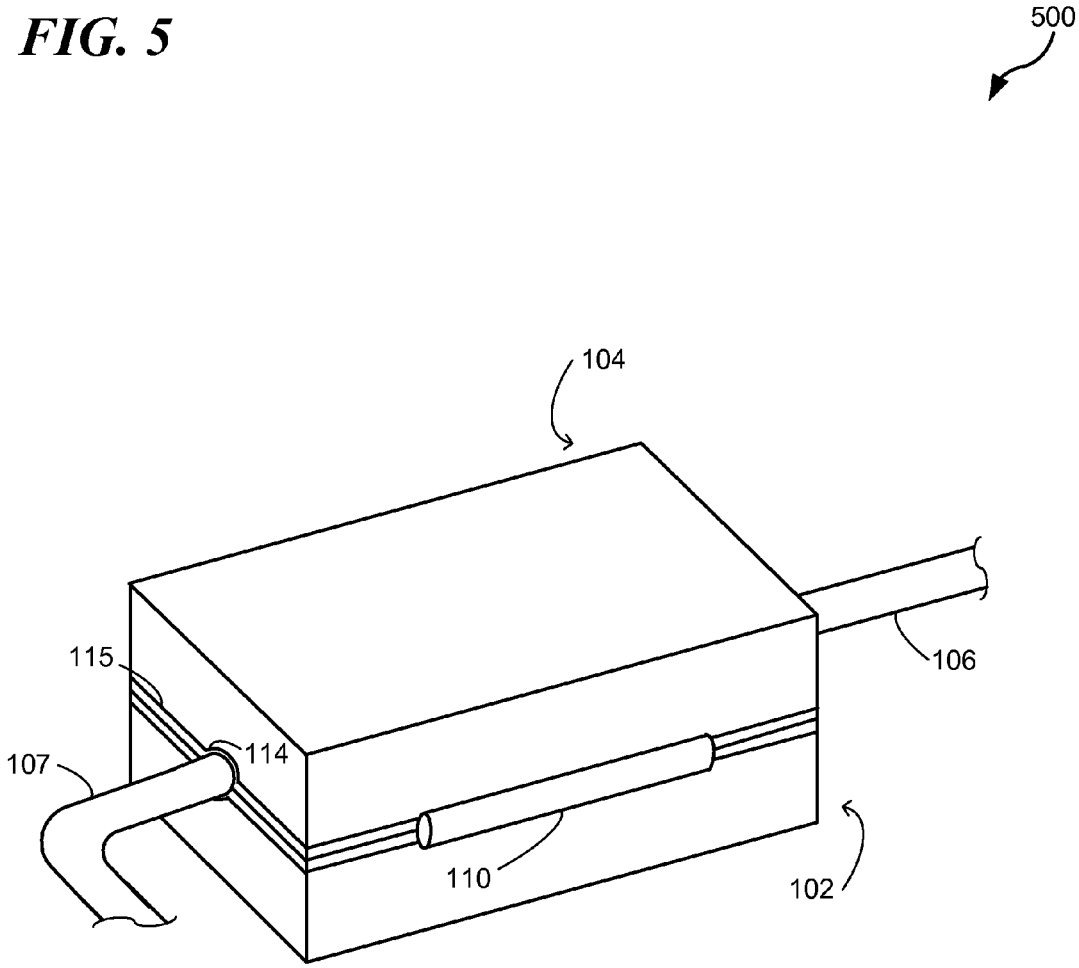
FIG. 5 is an oblique rear view of the embodiment shown in FIG. 1 in the closed position.

FIG. 4 is an oblique front view of the embodiment shown in FIG. 1 in the closed position. The latch fastener is shown closed into place. The latch can be closed and locked with snap fasteners, or clips, or other latching mechanisms known to one of ordinary skill in the art. FIG. 5 is an oblique rear view of the embodiment shown in FIG. 1 in the closed position.

Figure 6:
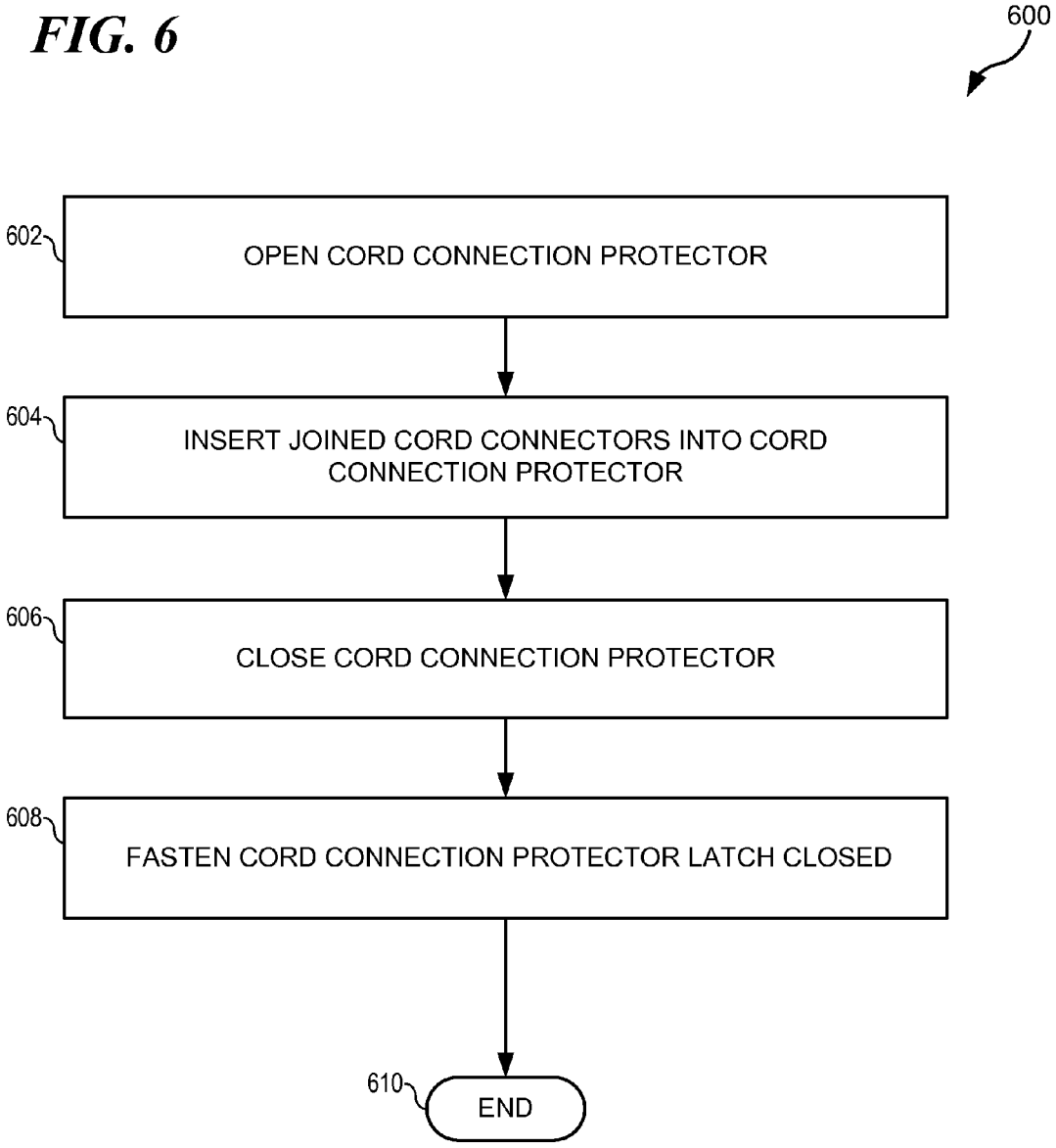
FIG. 6 is a flowchart detailing the steps of using an embodiment of the invention.

FIG. 6 is a flowchart detailing the steps of using an embodiment of the invention. First, the cord connection protector is opened 602, and then joined cord connectors are inserted into the protector 604. The cord connection protector is then closed 606, and the cord connection protector latch is then closed 608.

In preferred embodiments, the cord connection protector is capable of preventing separation of the cord connectors, as well as preventing moisture from contacting the cord connectors. Furthermore, in preferred embodiments the cord connection protector is capable of preventing performance-disturbing pressure from being placed upon the cord connectors, including potential crushing of the cord connectors. In preferred embodiments, the cord connection protector is made from material of sufficient robustness so as to enable repeated use, such as rubber, and in some embodiments, hard rubber.

Other modifications and implementations will occur to those skilled in the art without departing from the spirit and the scope of the invention as claimed. Accordingly, the above description is not intended to limit the invention except as indicated in the following claims.

What is claimed is:

1. A solid molded cord connection protector for robust protection of joined cord connectors, the cord connection protector comprising:

a bottom robust solid mold that is able to conform substantially to a bottom side of two joined cord connectors;

a top robust solid mold that is able to substantially conform to a top side of two joined cord connectors;

a hinge connecting the top robust solid mold to the bottom robust solid mold, so as to enable pivoting of the top robust solid mold relative to the bottom robust solid mold about the hinge; and a fastener capable of fastening the bottom robust solid mold to the top robust solid mold after they hingedly close upon each other, so as to completely enclose the solid mold of the cord connection protector firmly around the entire surface of the joined portions of the two cords, thereby providing robust protection of the joined cord connectors and robust protection of the cord connection.

2. The cord connection protector of claim 1, wherein the cord connection protector is capable of preventing separation of the cord connectors.

3. The cord connection protector of claim 1, wherein the cord connection protector includes a feature that is capable of preventing moisture from contacting the cord connectors.

4. The cord connection protector of claim 1, wherein the cord connection protector is capable of preventing performance-disturbing pressure from being placed upon the cord connectors.

5. The cord connection protector of claim 1, wherein the cord connection protector is capable of preventing crushing of the cord connectors.

6. The cord connection protector of claim 1, wherein the cord connection protector is made from material of sufficient robustness so as to enable repeated use.

7. The cord connection protector of claim 1, wherein the material is rubber.

8. The cord connection protector of claim 1, further comprising:

at least one channel for accommodating at least one of the cord portions.

9. The cord connection protector of claim 1, further comprising a watertight seal.

10. The cord connection protector of claim 1, wherein the seal is a rubber lining.

* * * * *